US005536013A

United States Patent [19]

Pocklington

[11] Patent Number: 5,536,013

[45] Date of Patent: Jul. 16, 1996

[54] GOLF BALL

[75] Inventor: Terence W. Pocklington, Tupelo, Miss.

[73] Assignee: Hansberger Precision Golf Incorporated, Pontotoc, Miss.

[21] Appl. No.: 386,812

[22] Filed: Feb. 8, 1995

Related U.S. Application Data

[63] Continuation-in-part of Ser. No. 81,631, Jun. 23, 1993, abandoned.

[51] Int. Cl.[6] ..... A63B 37/14

[52] U.S. Cl. ..... 473/384

[58] Field of Search ..... 273/232, 62; 40/327

[56] References Cited

U.S. PATENT DOCUMENTS 1,666,699 4/1928 Hagen ..... 273/232
1,716,435 6/1929 Fotheringham ..... 273/232

FOREIGN PATENT DOCUMENTS 2215621 9/1989 United Kingdom ..... 273/232
2231805 11/1990 United Kingdom ..... 273/232

*Primary Examiner*—George J. Marlo
*Attorney, Agent, or Firm*—Rockey, Rifkin & Ryther

[57] ABSTRACT

A golf ball defining a spherical outer surface and a plurality of spaced-apart dimples formed in the surface. The dimples comprise a central raised portion and a surrounding depressed portion with the depressed portion having a lateral dimension along any straight line extending through the center of the central portion and from one outer edge to the opposite outer edge of the depressed portion. The maximum depth of the depressed portion is from 0.008 to 0.015 inches and the raised portion extends outwardly from the depressed portion to the position of the spherical outer surface. The maximum lateral dimension of the raised portion, measured parallel to the spherical outer surface, is less than one-half the minimum lateral dimension of the depressed portion. The total effective volume of the dimples comprising the cumulative volume occupied by the depressed portions of all dimples formed in said surface is greater than 0.021 cubic inches.

7 Claims, 3 Drawing Sheets

GOLF BALL

BACKGROUND OF THE INVENTION

This application is a continuation-in-part of application Ser. No. 081,631 filed on Jun. 23, 1993, now abandoned.

This invention relates to golf balls and in particular to golf balls having dimples formed on the surface. The golf balls are of conventional design in the sense that specifications of the United States Golf Association are complied with from the standpoint of parameters such as an outer diameter of a minimum of 1.680 inches.

Conventional golf ball dimples are commonly circular, square or pentagonal in shape, but may exhibit various other geometric configurations. The dimples have a maximum central depth of about 0.008 to about 0.015 inches. Variations in dimple geometry, size and depth and variations in patterns over the golf ball surface have been recognized as affecting golf ball performance.

Various dimple patterns designed to enhance the performance characteristics of golf balls are disclosed in U.S. Pat. Nos. 4,932,664 and 5,201,522 to Pocklington et al. and assigned to the common assignee, which patents are incorporated herein by reference in their entirety.

Other dimple patterns comprising a central portion with a surrounding depressed portion have been suggested as set forth in Hagen U.S. Pat. No. 1,666,699 and Fotheringham U.S. Pat. No. 1,716,435.

The dimple construction shown in Hagen U.S. Pat. No. 1,666,699 can be described as a truncated cone with a spherical section protruding convexly from the point of truncation of the cone. The spherical section is of such radius that when the radius of the spherical section is aligned with the radius of the golf ball, the surface of the spherical section and the surface of the golf ball are coincident and meet at a single point. This results in a plurality of dimples comprising a plurality of spaced-apart annular areas which are depressed relative to the golf ball surface. In Fotheringham, the depressed portions are achieved by providing a plurality of narrow annular rings at spaced locations over the golf ball surface.

The flight distance of a golf ball is determined by the number and depth of the dimples on the surface of the ball. More specifically, the total effective volume of the dimples is a predictor of the flight performance of a ball. Since golf balls of various constructions have different spin rates and hence different lift characteristics, no one specific number can, however, be chosen for the effective volume of dimples which will give the greatest performance.

It has been concluded, nevertheless, that for current golf ball constructions, the total effective volume of the dimples on a golf ball must be a minimum of about 0.021 cubic inches. Anything less will result in unsatisfactory performance for the flight of the golf ball and the Hagen and Fotheringham balls are examples of such unsatisfactory designs.

SUMMARY OF THE INVENTION

In accordance with this invention, a golf ball is produced with a plurality of dimples having a novel dimple design. The novel dimple design has a depressed portion completely surrounding a central raised portion. The depressed portion has a conventional depth ranging from about 0.008 to about 0.015 inches. The central raised portion rises to at or about the arc created by the common land area of the ball's outer spherical surface.

All dimples on a ball may be of the novel design or a mixture of these with standard dimples may be used. In addition, the depressed and raised portions of the dimples may be the same or of different geometries. For example, either or both of the depressed and raised portions may be in the shape of a circle, rectangle, pentagon, diamond, oval, or other geometric design. The geometries of the depressed and raised portions may be varied to enhance the performance as well as the appearance of the ball. In the preferred form of this invention, both the raised and central portions of the dimple are in the shape of a circle.

The sizes of the dimples and their respective raised and depressed portions preferably are controlled to enhance both the performance and uniformity of appearance of the golf ball. Typically, the sizes of the dimples will depend on the number thereof; thus, where greater numbers of dimples are employed, the size will be smaller, and vice versa. The sizes also are dependent on the geometries of the dimples and the "spacing" between dimples which is defined as the distance between the closest points of the edges of adjacent dimples. Typically, dimple sizes will vary between about 0.075 and about 0.175 inches in diameter where a circle is involved, and the spacing between the dimples will vary from at or near touching to about 0.070 inches.

It is, therefore, an object of the present invention to provide a golf ball with dimples designed to achieve an improved performance of the golf ball.

Another object of the present invention is to provide a golf ball with dimples designed to enhance the appearance of the ball.

Additional features and advantages of the present invention will become apparent to those skilled in the art from the following detailed description of preferred, but nonetheless illustrative, embodiments exemplifying the invention as presently perceived.

DESCRIPTION OF THE DRAWINGS

The detailed description particularly refers to the accompanying drawings in which.

DESCRIPTION OF THE PREFERRED EMBODIMENT

Figure 1:
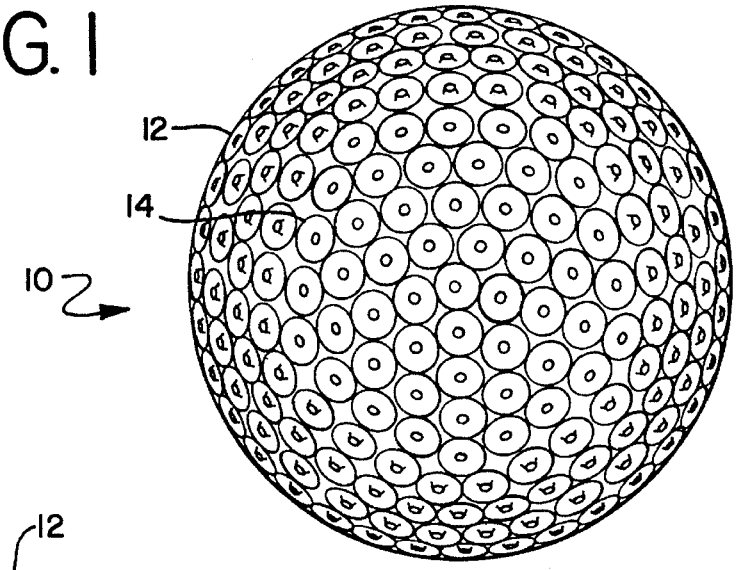
FIG. 1 is an elevational view of a golf ball produced in accordance with this invention.

The surface 12 of the golf ball 10 shown in FIG. 1 includes dimples 14 formed in accordance with the present invention.

Figure 2:
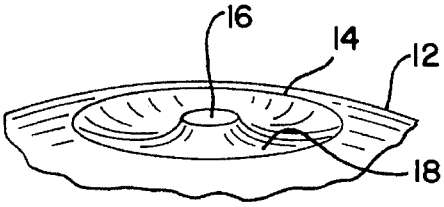
FIG. 2 is a fragmentary perspective view of the dimple configuration in the golf ball shown in FIG. 1.
Figure 3:
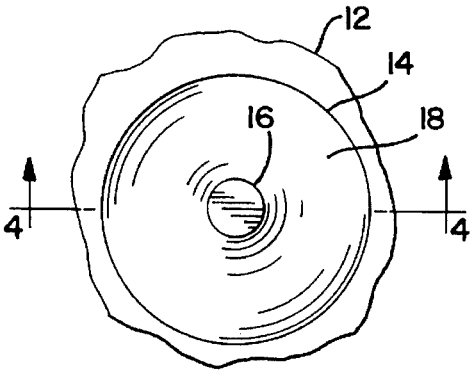
FIG. 3 is a plan view of a dimple configuration produced in accordance with this invention having a circular geometry.

As best shown in FIGS. 2 and 3, the dimples 14 have a central raised portion 16 and a depressed portion 18 completely surrounding the raised portion 16. Each of the raised and depressed portions is circular in shape.

Figure 4:
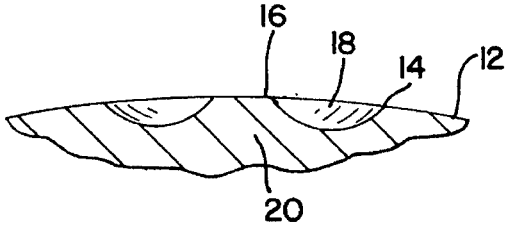
FIG. 4 is a fragmentary cross-sectional view taken generally along line 4—4 of FIG. 3.

Referring to FIG. 4, the raised portion 16 extends outwardly from the depressed portion 18 at or about the position of the spherical outer surface 12, forming a toroid configuration 20. The depressed portion 18 of the dimple has a maximum central depth ranging from about 0.008 to about 0.015 inches.

Figure 5:
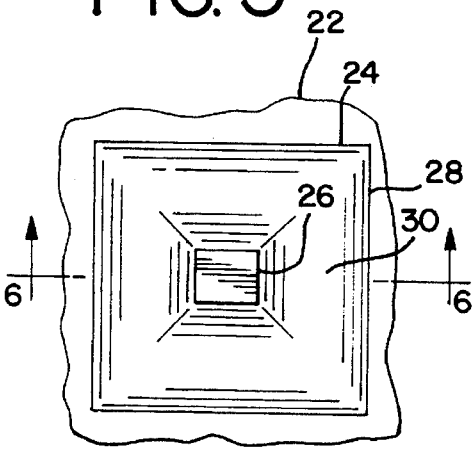
FIG. 5 is a plan view of a dimple configuration produced in accordance with this invention having a rectangular geometry in the shape of a square.
Figure 6:
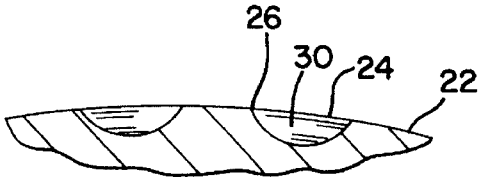
FIG. 6 is a fragmentary cross-sectional view taken generally along line 6—6 of FIG. 5.

As shown in FIG. 5, the dimple 24 formed in spherical outer surface 22 has a rectangular geometry wherein the sides 28 of the rectangle are of equal length. A central raised portion 26 is surrounded by a depressed portion 30. Sections of both of the raised portion 26 and the depressed portion 30 are in the shape of a rectangle. Referring to FIG. 6, the raised portion 26 extends outwardly from the depressed portion 28 to at or about the position of said spherical outer surface 22.

In one mode of carrying out the invention as presently perceived, both the raised portion and the depressed portion of the dimple configuration are circular in shape as shown in FIGS. 1–4. The maximum central depth of the depressed portion is about 0.010 inches. The circular depressed dimple portions are of three different diameters, about 0.160 inches, about 0.155 inches, and about 0.135 inches. The diameter of the circular raised dimple portion is about 0.035 inches. This arrangement permits the employment of about 432 dimples in the outer spherical surface spaced from at or near touching to about 0.070 inches.

In a dimple 24 having a square geometry as shown in FIGS. 5 and 6, the preferred dimple embodiment is that of a depressed dimple portion 30 having a square edge 28 of about 0.160 inches in length. The depressed portion 30 has a maximum depth of about 0.010 inches. The preferred size of an edge of the square raised portion 26 at the outer spherical surface 22 is about 0.035 inches in length.

Figure 7:
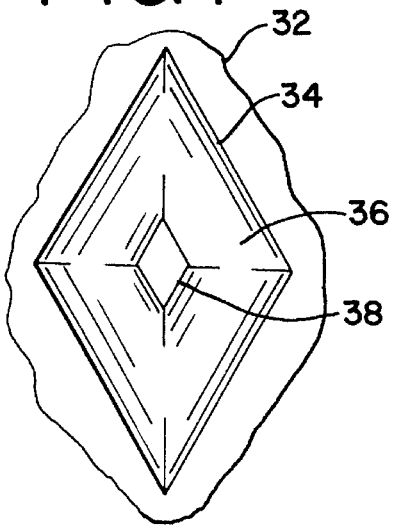
FIG. 7 is a plan view of a dimple configuration produced in accordance with the invention having a diamond geometry.

In a dimple 34 formed in the spherical outer surface 32, having a diamond geometry as shown in FIG. 7, the depressed dimple portion 36 is in the shape of a diamond. The raised dimple portion 38 is also in the shape of a diamond.

Figure 8:
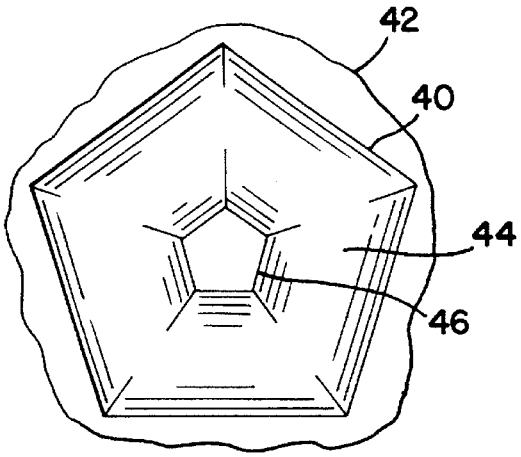
FIG. 8 is a plan view of a dimple configuration produced in accordance with the invention having a pentagonal geometry.

In a dimple 40 formed in the spherical outer surface 42, having a pentagonal geometry as shown in FIG. 8, the depressed dimple portion 44 is in the shape of a pentagon. The raised dimple portion 46 is also in the shape of a pentagon.

It will be understood that alternative dimple geometries are contemplated for use in accordance with this invention. It is contemplated that either or both of the raised and depressed dimple portions may be configured in the shape of a circle, square, pentagon, diamond and the like. Accordingly, a section of the raised portion of the dimple taken perpendicular to the radius of the golf ball may be in the shape of a circle, square, pentagon, diamond and the like. Likewise, a section of the depressed portion of the dimple taken perpendicular to the radius of the golf ball may be in the shape of a circle, square, pentagon, diamond and the like. The geometric shapes of the sections of the raised and depressed portions as herein described may be the same or different at any one time, as in FIGS. 9–11.

Figure 9:
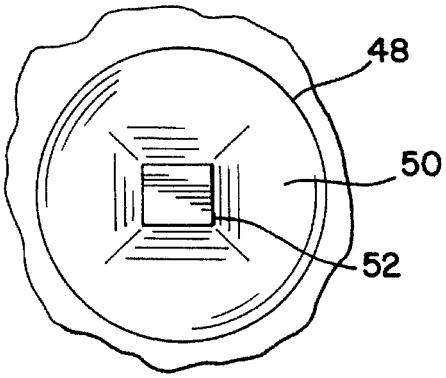
FIG. 9 is a plan view of a dimple configuration produced in accordance with the invention having a circular depressed dimple portion and a square raised dimple portion.

Thus, it is contemplated that, for example, as shown in FIG. 9, a dimple 48 made in accordance with the present invention may have a configuration wherein a section of the depressed portion 50 taken perpendicular to the radius of the ball may be in the shape of a circle and a section of the raised portion 52 taken perpendicular to the radius of the ball may be in the shape of a square.

Figure 10:
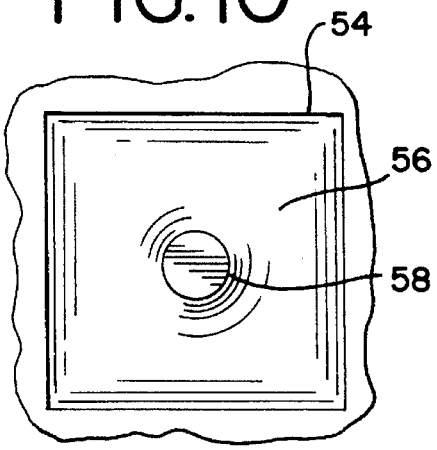
FIG. 10 is a plan view of a dimple configuration produced in accordance with the invention having a square depressed dimple portion and a circular raised dimple portion.

Alternatively, and as shown in FIG. 10, a dimple 54 made in accordance with the present invention has a configuration wherein a section of the depressed portion 56 taken perpendicular to the radius of the ball may be in the shape of a square and a section of the raised portion 58 taken perpendicular to the radius of the ball may be in the shape of a circle.

Figure 11:
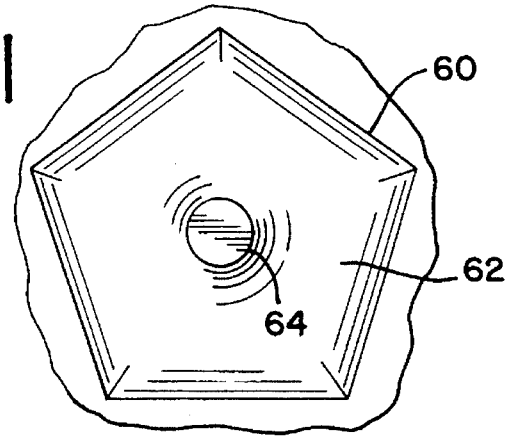
FIG. 11 is a plan view of a dimple configuration produced in accordance with the invention having a pentagonal depressed dimple portion and a circular raised dimple portion.

As a further example of the possible combined geometric shapes, FIG. 11 depicts a dimple 60 wherein a section of the depressed portion 62 taken perpendicular to the radius of the ball may be in the shape of a pentagon and a section of the raised portion 64 is in the shape of a circle. Various other possible combinations achievable by matching others of the particular shapes will also be obvious to those of skill in the art.

Golf balls within the preferred scope of the invention will generally have a maximum dimple depth of 0.010 inches. Furthermore, for such preferred forms, the maximum dimension "d" of the raised central portion of a dimple, as shown in FIG. 12, will always be less than one-half the dimension "D" of the dimple.

Figure 12:
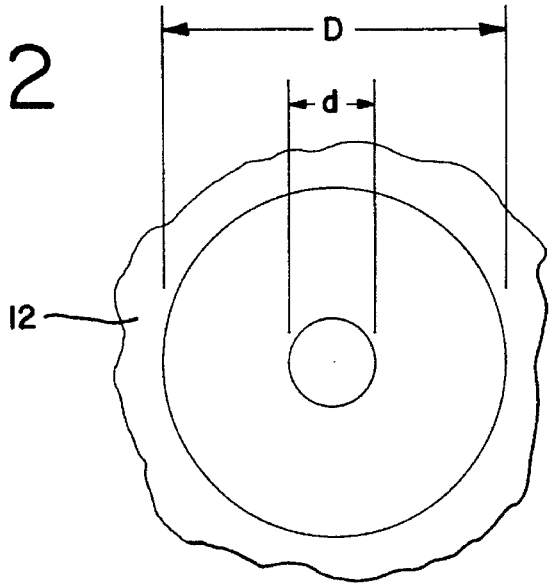
FIG. 12 is a plan view of the dimple configuration as illustrated in FIGS. 1–4 and showing general dimensional relationships.
Figure 13:
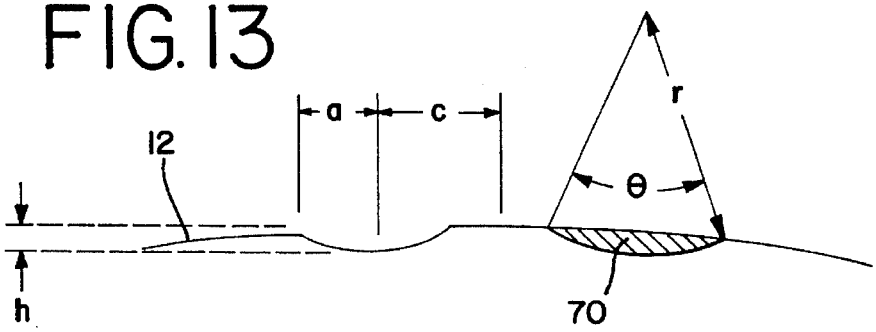
FIG. 13 is a fragmentary cross-sectional view of a dimple configuration as illustrated in FIGS. 1–4 and showing general dimensional relationships; and, FIG. 14 is an elevational view of a golf ball chracterized by a mixture of dimples of the configuration of this invention with dimples of standard design.

Each of the dimensions "d" and "D" is constant wherever measured when the circular forms of FIGS. 12 and 13 are considered. With respect to the other forms of the invention either or both of these dimensions may vary depending on the location of a line drawn through the center of the raised portion from one outer edge to an opposite outer edge of the depressed portion. The invention provides that, with respect to such forms, the maximum lateral extent of the central portion will be less than one-half of the minimum lateral dimension of the depressed portion.

By utilizing these parameters, the total effective volume of the dimples on a golf ball surface can be controlled. Thus, as set forth in the introductory portion of this disclosure, performance characteristics of a golf ball will vary depending on the total effective volume of dimples formed on the ball surface. A minimum of 0.021 cubic inches is believed to be necessary to achieve satisfactory performance and the golf ball example set forth above and shown in FIGS. 1–4 achieves this goal. Specifically, a ball with the dimensions set forth above is characterized by a total effective volume of approximately 0.046436.

This volume is calculated by considering the fact that the dimple of FIGS. 1–4 comprises a section of a toroidal or "doughnut" shape. The maximum depth of the dimple is 0.01 inches and the average dimple diameter is 0.145 inches with a total number of dimples of 432. Referring to FIG. 13, therefore, the dimension "h" used in the calculation discussed hereinafter is 0.01 inches. Considering a raised section diameter of 0.035 inches, the dimensions "a" and "c" shown in this figure are calculated as follows:

$$a=\frac{1}{2}\left(\frac{D}{2}-\frac{d}{2}\right)$$

$$c=\frac{D}{2}-a.$$

For this example, "a" equals 0.0275 inches and "c" equals 0.045 inches.

The Theorem of Pappus for the volumes of solids of revolution provides:

$$\text{Volume of toroidal section}=2\pi c A$$

Where: c is the axial distance from the center of revolution to the center of the area being revolved and the area to be revolved (A) is the hatched area 70, all as shown in FIG. 13.

The area to be revolved (A) is determined, using the Pythagorean Theorem, by first determining the radius r (FIG. 13) as follows:

$$r^2=(r-h)^2+a^2$$

$$r^2=r^2-2rh+h^2+a^2$$

$$2rh=h^2+a^2$$

$$r=\frac{h^2+a^2}{2h}$$

The area ($A_c$) of the circle of radius r is calculated as:

$$A_c=\pi r^2$$

The angle θ formed by the intersection of r with the endpoints of the dimple is calculated as:

$$\text{Sin}\frac{\theta}{2}=a/r$$

$$\frac{\theta}{2}=\text{Sin}^{-1}\,a/r$$

$$\theta=2\,\text{Sin}^{-1}\,a/r$$

The ratio of θ/360 is the percentage of the total area of the circle occupied by the segment of the circle.

θ/360 ($\pi r^2$) is the area of this segment. The area above the dimple is merely a triangle of base 2a and height (r–h). The area of this triangle ($A_t$) is:

$$A_t=a\,(r-h)$$

By subtracting the area of the triangle from the area of the circular segment, one obtains the area (A) (the cross hatched area 70) of the dimple to be revolved. This formula is:

$$A=\theta/360\,(\pi r^2)-a\,(r-h)=2(\text{Sin}^{-1}\,a/r)/360\,(\pi r^2)-a\,(r-h).$$

The depth of the dimple in the above-mentioned example (h=0.01) and half the chord length of the dimple (a=0.0275) are known. The radius (r) which will generate the shape show h is, therefore:

$$r^2=(r-0.01)^2+(0.0275)^2$$

$$r=0.0428125$$

This yields an area (A) of 0.0003762 square inches.

Substituting this into our formula from the theorem of Pappus yields:

$$\text{Volume of toroidal section}=2(3.1416)\,(0.045)\,(0.003762)=0.0001064\text{ cubic inches}$$

The total effective volume of the dimples for the golf ball of the example is:

$$\text{Total dimple vol}=432(0.0001064)=0.045965\text{ cubic inches}$$

The following table sets forth additional examples of balls within the scope of the invention. In each instance, a ball of the form shown in FIGS. 1–4 is involved.

| | a | h | r | A | c | volume of single dimple | No. of Dims | Vol of Dims on Ball |
|---|---|---|---|---|---|---|---|---|
| 1. | .0275 | .0050 | .0781250 | 0.0001845 | .045 | 0.0000522 | 432 | 0.022540 |
| 2. | .0275 | .0070 | .0575179 | 0.0002600 | .045 | 0.0000735 | 432 | 0.031753 |
| 3. | .0275 | .0060 | .0660208 | 0.0002221 | .045 | 0.0000627 | 432 | 0.027126 |
| 4. | .0275 | .0055 | .0715000 | 0.0002033 | .045 | 0.0000575 | 432 | 0.024829 |
| 5. | .0320 | .0050 | .1049000 | 0.0002144 | .048 | 0.0000647 | 380 | 0.024568 |
| 6. | .0320 | .0043 | .1212198 | 0.0001841 | .048 | 0.0000555 | 380 | 0.021102 |
| 7. | .0320 | .0054 | .0975148 | 0.0002317 | .048 | 0.0000699 | 380 | 0.026555 |
| 8. | .0200 | .0080 | .0290000 | 0.0002200 | .040 | 0.0000553 | 450 | 0.024883 |
| 9. | .0200 | .0100 | .0250000 | 0.0002796 | .040 | 0.0000703 | 450 | 0.031617 |

Figure 14:
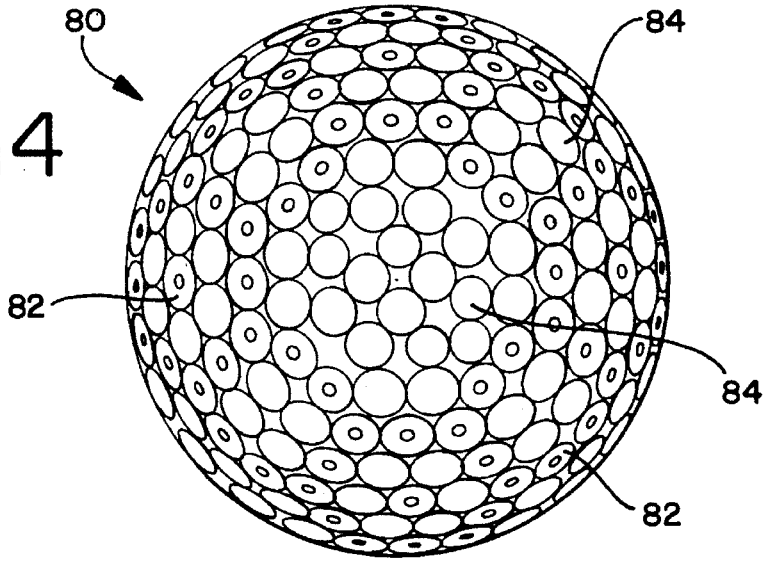

FIG. 14 illustates an alternative form of the invention wherein the dimple configuration of FIGS. 1–4 (dimples 82) is used for only part of the total dimples on the golf ball 80. The balance of the dimples (dimples 84) are of conventional design, for example, as described in the aforementioned U.S. Pat. No. 5,201,522. The dimples 82 are arranged in hexagonal patterns each having one dimple 82 in the center. A total of 152 dimples 82 are used in combination with 228 dimples 84 in this example.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A golf ball defining a spherical outer surface and a plurality of spaced-apart dimples formed in said surface, said dimples comprising a central raised portion and a surrounding depressed portion, said depressed portion having a lateral dimension along any straight line extending through the center of said central portion and from one outer edge to the opposite outer edge of said depressed portion, the maximum depth of said depressed portion being from 0.008 to 0.015 inches, said raised portion extending outwardly from the depressed portion to the position of said spherical outer surface, the maximum lateral dimension of said raised portion, measured parallel to said spherical outer surface, being less than one-half the minimum lateral dimension of said depressed portion, and wherein the total effective volume of the dimples comprising the cumulative volume occupied by the depressed portions of all dimples formed in said surface is greater than 0.021 cubic inches.

2. A golf ball according to claim 1 having at least about 380 circular dimples and a circular raised portion within each dimple, the diameters of the depressed portions of the dimples varying between about 0.135 and 0.160 inches, and the diameter of the central raised portion of the dimples being in the order of about 0.035 inches.

3. A golf ball according to claim 1 wherein a section of said raised portion taken perpendicular to a radius of said ball extending through said raised portion is in the shape of a circle.

4. A golf ball according to claim 1 wherein a section of said depressed portion taken perpendicular to a radius of said ball extending through said depressed portion is in the shape of a circle.

5. A golf ball according to claim 1 wherein a section of said raised portion taken perpendicular to a radius of said ball extending through said raised portion comprises a shape selected from the group consisting of a circle, rectangle, pentagon, and diamond, and wherein a section of said depressed portion taken perpendicular to a radius of said ball extending through said depressed portion comprises a shape selected from the group consisting of a circle, rectangle, pentagon and diamond.

6. A golf ball according to claim 1 wherein dimples comprising said raised portion and surrounding depressed portion make up only part of the dimples on the ball surface.

7. A golf ball according to claim 6 wherein a total of 380 dimples are provided and wherein 152 of the dimples comprise said raised portion and surrounding depressed portion.

* * * * *